US007698857B2

(12) United States Patent
Skov et al.

(10) Patent No.: US 7,698,857 B2
(45) Date of Patent: Apr. 20, 2010

(54) ROOF ASSEMBLY METHOD AND APPARATUS

(75) Inventors: Erik Skov, Akron, OH (US); Timothy Pierzynski, Apple Creek, OH (US)

(73) Assignee: Rubbermaid Incorporated, Huntersville, NC (US)

( * ) Notice: Subject to any disclaimer, the term of this patent is extended or adjusted under 35 U.S.C. 154(b) by 348 days.

(21) Appl. No.: 11/469,498

(22) Filed: Sep. 1, 2006

(65) Prior Publication Data

US 2007/0271862 A1 Nov. 29, 2007

Related U.S. Application Data

(60) Provisional application No. 60/808,402, filed on May 25, 2006.

(51) Int. Cl.
*E04B 7/02* (2006.01)

(52) U.S. Cl. ..... 52/90.1; 52/763; 52/582.1; 52/584.1

(58) Field of Classification Search ..... 52/90.1, 52/92.2, 533, 535, 536, 543, 551, 478, 763, 52/582.1, 585.1, 520, 550, 91.1, 91.3, 483.1, 52/584.1, 460

See application file for complete search history.

(56) References Cited

U.S. PATENT DOCUMENTS 1,864,684 A * 6/1932 Woodruff ..... 220/1.5
2,730,208 A * 1/1956 Valentine ..... 52/464
2,753,962 A * 7/1956 McBerty ..... 52/93.1
3,082,576 A * 3/1963 Bailey ..... 52/583.1
3,154,179 A * 10/1964 Harry ..... 52/478
3,363,381 A * 1/1968 Forrest ..... 52/464
3,376,676 A * 4/1968 Tatevossian ..... 52/93.2
4,193,230 A * 3/1980 Piana ..... 52/92.2
4,194,717 A * 3/1980 Easton et al. ..... 249/192
4,575,981 A * 3/1986 Porter ..... 52/309.9
5,251,868 A * 10/1993 Trimmer et al. ..... 249/196
5,277,011 A * 1/1994 Serrano Martin ..... 52/588.1
5,425,207 A * 6/1995 Shayman ..... 52/79.9
5,628,158 A * 5/1997 Porter ..... 52/309.9
5,979,138 A * 11/1999 Allen ..... 52/745.09
5,987,839 A * 11/1999 Hamar et al. ..... 52/582.1
5,996,299 A * 12/1999 Hsueh ..... 52/481.2
6,023,899 A * 2/2000 Mecozzi ..... 52/396.04
6,032,427 A * 3/2000 Randjelovic ..... 52/584.1

(Continued)

FOREIGN PATENT DOCUMENTS

WO WO 8703321 A1 * 6/1987

*Primary Examiner*—Robert J Canfield
*Assistant Examiner*—Brent W Herring
(74) *Attorney, Agent, or Firm*—Dennis J. Williamson; Moore & Van Allen, PLLC

(57) ABSTRACT

A frame is constructed to support a roof. A plurality of panels can be slid into position on the frame from the ground. A mating channel joint is formed between adjacent panels that allows one panel to be slid over the adjacent panel into the proper position. The panels engage frame members to properly position the panels on the roof. The roof panels are formed with mounting structures located on the interior or underside thereof. The mounting structures include holes or other receptacles for receiving a rigid connector member. The frame members are also provided with receptacles for receiving the connector member. The connector member is inserted through the first mounting structure, through the receptacle in the frame member and through the mounting structure of the adjacent panel.

26 Claims, 3 Drawing Sheets

U.S. PATENT DOCUMENTS 6,260,321 B1 * 7/2001 Rudduck ..... 52/474
6,282,858 B1 * 9/2001 Swick ..... 52/533
6,415,580 B2 * 7/2002 Ojala ..... 52/794.1
6,427,256 B1 * 8/2002 Mullett et al. ..... 4/476
6,581,337 B1 * 6/2003 Skov et al. ..... 52/79.5
6,993,875 B2 * 2/2006 Rudduck ..... 52/474
7,003,863 B2 * 2/2006 Skov et al. ..... 29/453
7,021,678 B1 * 4/2006 Raoult ..... 292/63
7,509,776 B2 * 3/2009 Reisman ..... 52/281
2002/0002805 A1 * 1/2002 Yamaguchi et al. ..... 52/396.05
2002/0088196 A1 * 7/2002 Haddock ..... 52/543
2003/0188500 A1 * 10/2003 Voegele ..... 52/466
2003/0230901 A1 * 12/2003 Krynski ..... 292/210
2004/0074158 A1 * 4/2004 De Zen ..... 52/79.9
2004/0187400 A1 * 9/2004 Anderson et al. ..... 52/79.1
2005/0210760 A1 * 9/2005 Mower et al. ..... 52/64
2007/0157530 A1 * 7/2007 Uffner et al. ..... 52/90.1
2007/0261340 A1 * 11/2007 Cecilio et al. ..... 52/311.1
2008/0115432 A1 * 5/2008 Groppe ..... 52/220.2

* cited by examiner

ROOF ASSEMBLY METHOD AND APPARATUS

This application claims the benefit of priority under 35 U.S.C. §119(e) to the filing date of U.S. Provisional Application No. 60/808,402 filed on May 25, 2006, which is incorporated herein by reference in its entirety.

The invention relates to storage sheds and other building structures and more particularly to an improved roof assembly method and apparatus.

BACKGROUND

There are many different roofing constructions in existence today that utilize different materials and construction methodologies. The most common roofing construction is to nail or screw fasteners perpendicularly through the roof cladding or panels and into the roof framing members. With this design it is possible for the fasteners to pull out of the frame. Moreover, with most roof constructions it is necessary for the person installing the roof to be outside on top of the roof. This presents a health and safety risk to the person installing the roof. This risk may be even greater in do-it-yourself applications where the person is relatively inexperienced.

Thus, an improved roof construction is desired.

SUMMARY OF THE INVENTION

A frame is constructed to support a roof. A plurality of panels can be slid into position on the frame from the ground. A mating channel joint is formed between adjacent panels that allows one panel to be slid over the adjacent panel into the proper position. The panels engage frame members to properly position the panels on the roof. The roof panels are formed with mounting structures located on the interior surface thereof. The mounting structures include holes or other receptacles for receiving a rigid connector member. The frame members are also provided with receptacles for receiving the connector member. The roof panels are located on the frame members such that the mounting structure of one roof panel is aligned with the mounting structure of the adjacent panel and both mounting structures are aligned with a receptacle formed on the framing member. The connector member may be inserted through the first mounting structure, through the receptacle in the frame member and through the mounting structure of the adjacent panel. The connector member can be inserted through the panels and frame member from the interior of the structure such that the installer does not have to be on the roof during installation.

DETAILED DESCRIPTION OF EMBODIMENTS OF THE INVENTION

The roof assembly of the invention is shown generally at 1 in the figures and consists of a plurality of roof panels 2*a* through 2*n*. In one embodiment the roof panels may be constructed of blow-molded plastic. Such a roof construction is commonly used in pre-fabricated storage sheds. While the construction method of the invention has particular use in such sheds it will be appreciated that the roof assembly method and apparatus of the invention has utility in any structure or building having an installed roof. While the panel has been described as being constructed of blow-molded plastic it could be made of other materials including extruded plastic, polymer composite, wood, steel, fiberglass or any other suitable roofing material.

The roof sections are supported and separated by a ridge cap 3 at the top of the roof. Corner caps 5 separate and support the roof at each of the hip joints. While a hip roof is illustrated it is to be understood that the method and apparatus of the invention may be used on roofs having different configurations.

Figure 5:
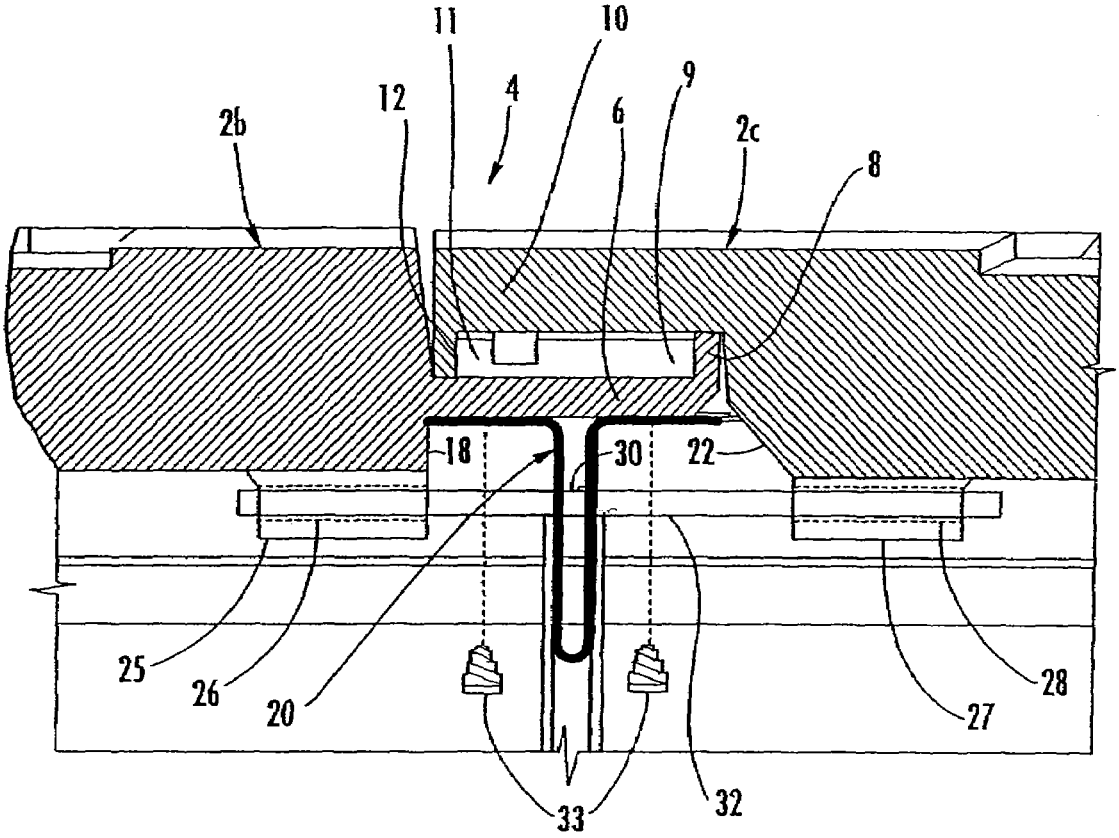
FIG. 5 shows a partial cross-section view of two roof panels and the mounting structure taken along line 5-5 of FIG. 1.

Referring to FIG. 5 the connection between adjacent roof panels and the roof frame is illustrated where roof panel 2*c* joins roof panel 2*b* at joint 4. Joint 4 is created by a flange 6 extending from the side of panel 2*b* for substantially the entire length thereof. Flange 6 is formed with an upstanding lip 8 to create a generally U-shaped channel 9 along the edge of panel 2*b*. A flange 10 extends from the side of panel 2*c* for substantially the entire length thereof. Flange 10 is formed with a downwardly extending lip 12 to create a generally inverted U-shaped channel 11 along the edge of panel 2*c*. Channel 9 engages channel 11 such that the lip 12 abuts flange 6 and lip 8 abuts flange 10. This construction creates a lap joint that drains water from the roof without leaking and helps to guide the panels onto the roof during assembly of the roof as will hereinafter be described.

Panel 2*b* is formed with a downwardly extending protrusion 18 that properly positions the roof panel on the frame member 20. Panel 2*b* has a chamfered downwardly extending protrusion 22 that also properly positions the roof panel on frame member 20. The protrusions 18 and 22 may extend for the length of the panel or may extend for a portion of the length of the panel including being arranged in segments.

The frame members 20 have a generally T-shaped cross-section where the panels rest on the top of the frame members. The frame members 20 extend along the seams between adjacent panels in the assembled roof and extend between the ridge cap 3 or corner cap 5 and the side walls 35 of the structure to support the roof panels. The frame members 20 may have a cross-section other than the illustrated T-shape. The frame members 20 may be made of extruded aluminum or polymer, pultruded polymer, wood or other rigid material.

To join the components, a first mounting structure 25 is located on the bottom surface of the panel and extends from panel 2*b* toward the interior of the building such that it is located under the panel when the panel is in place on the roof. The mounting structure may be formed integrally with the panel or it may be formed as a separate component such as a bracket secured to the panel. A through hole 26 is formed in mounting structure 25. A second mounting structure 27 extends from panel 2*c* toward the interior of the building such that it is located under the panel when the panel is in place on the roof. The mounting structure may be formed integrally with the panel or it may be formed as a separate component such as a bracket secured to the panel. A through hole 28 is formed in mounting structure 27. Through holes 26 and 28 are aligned with one another when the panels are properly positioned on the frame member 20. A through hole 30 is formed on frame member 20 that is aligned with through holes 26 and 28 when the panels are properly positioned on the frame member 20.

A rigid member such as a polymer or aluminum pin or rod 32 is inserted through holes 26, 28 and 30 to connect these members together. In one embodiment the pin 32 is retained in the through holes by a tight friction fit. The pin 32 may be coined or flattened at one end to increase the engagement by deforming slightly the material of the panels and/or frame member. Other mechanisms for securing the pin 32 in the panels and frame member may also be used such as forming screwthreads on the end of the pin that are engaged by mating nuts, using separate fasteners to engage the pin such as cotter pins, using a snap fit, deforming the pin or the like.

Once the pin 32 is inserted into the panels and frame member, separate fasteners 33 may be used to further secure these elements together. For example the fasteners may comprise self-threading machine screws that are driven up through the frame 20 and into the panels.

As is evident from the foregoing all of the structure required to secure the roof panels 2*a* through 2*n* to one another and to the frame members 20 is located interior of the building. As a result it is not necessary for the installer to climb onto the roof, or, depending on the height of the roof, even onto a high ladder, to install the roof panels. The system of the invention has particular application in storage sheds, storage buildings and other similar structures where the height of the roof in the assembled structure may be about eight feet. While the system of the invention has particular applicability in such structures it may be used in any structure.

Figure 8:
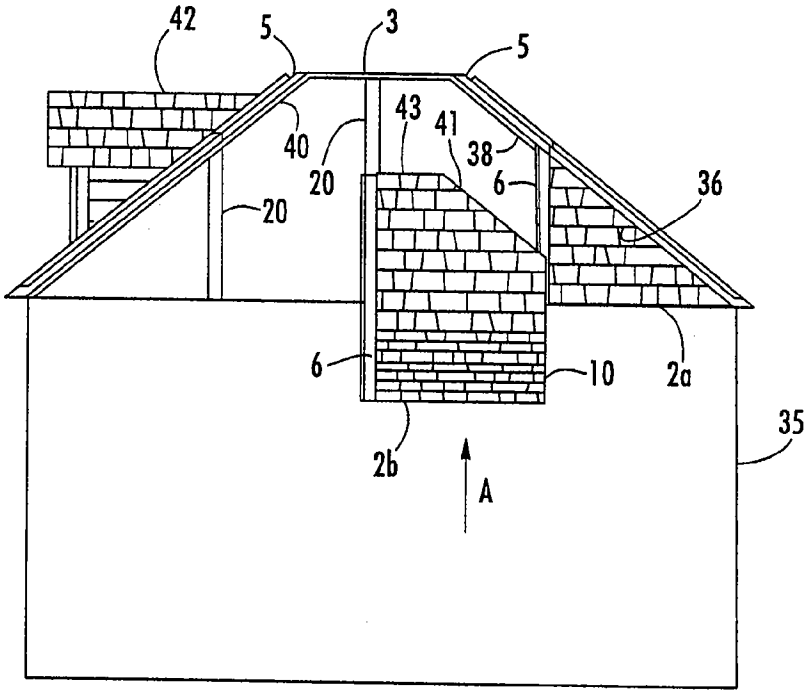
FIG. 8 illustrates the assembly method of the invention.

Referring to FIG. 8 to assemble the roof 1, the first panel 2*a* is slid onto the frame. Panel 2*a* can be slid in place from the outside of the structure without requiring the installer to be on top of the roof. Protrusion 18 guides the flange 6 along the frame member 20 until the upper end of the panel is inserted into a cavity formed in the corner cap 5.

Figure 1:
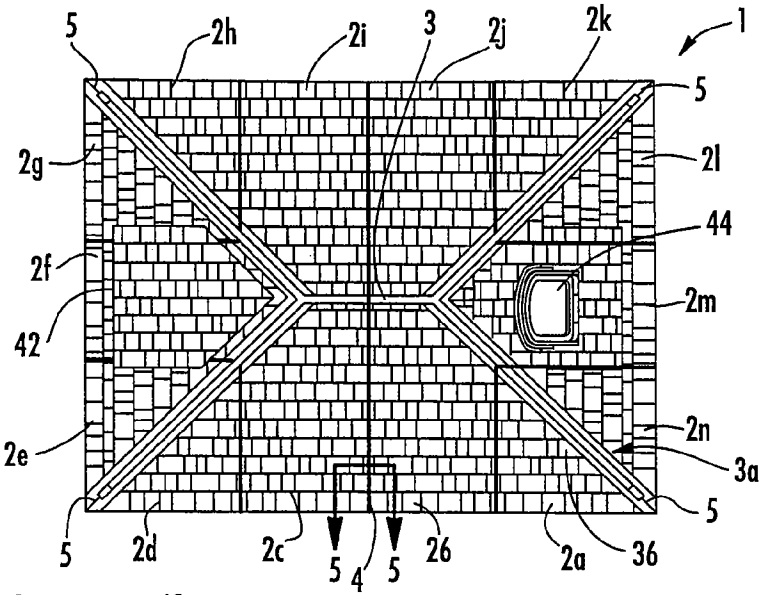
FIG. 1 is a top view of one embodiment of a roof assembly of the invention.
Figure 4:
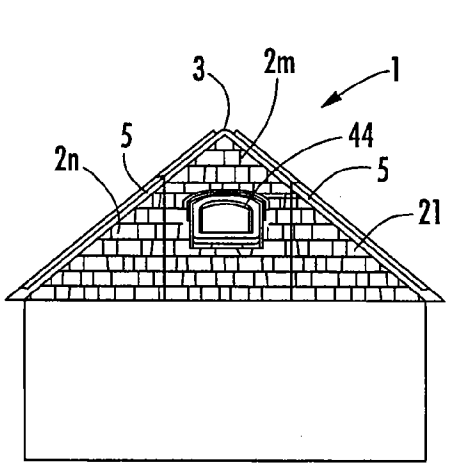
FIG. 4 is a back view of the embodiment of FIG. 1.
Figure 3:
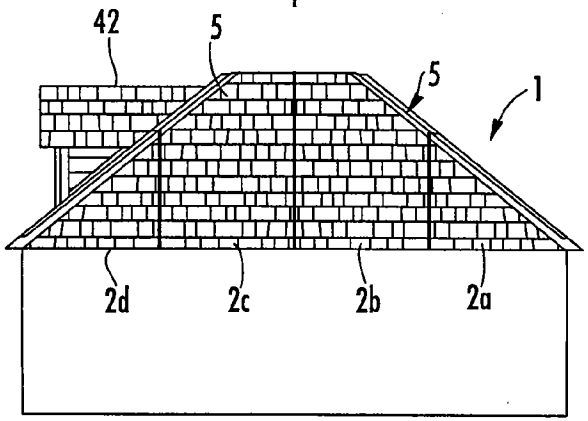
FIG. 3 is a front view of the embodiment of FIG. 1.
Figure 2:
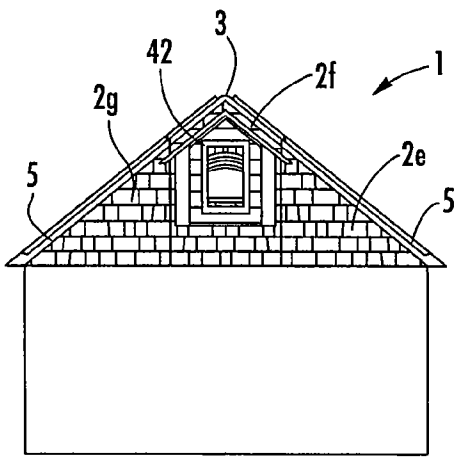
FIG. 2 is a side view of the embodiment of FIG. 1.
Figure 7:
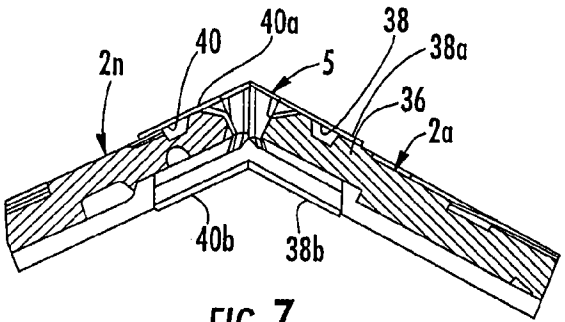
FIG. 7 shows a cross-section of a roof panel engaged with a corner cap.

The engagement of the panel with corner cap 5 is shown in greater detail in FIG. 7. In the illustrated hip roof the corner caps 5 extend from the corners of the side walls 35 of the structure to the ridge cap 3 although the specific location of the corner caps may vary depending on the type of structure and roof. A first cavity 38 is formed along one longitudinal edge of corner cap 5 and a second cavity 40 is formed along the opposite longitudinal edge of corner cap 5. In the illustrated embodiment the cavities 38 and 40 extend for substantially the entire length of the corner caps 5. Cavity 38 is formed by opposed flanges 38*a* and 38*b* and cavity 40 is formed by opposed flanges 40*a* and 40*b*. The edge 36 of panel 2*a* that faces and abuts corner cap 5 is inserted into cavity 38 formed by corner cap 5. The opposite side edge of corner cap 5 defines second cavity 40 that retains the edge 39 of panel 2*n* (FIG. 1). Likewise, the edge 41 of panel 2*b* will be retained in cavity 38 when panel 2*b* is in place. The corner cap 5 may retain a greater or fewer number of panels than shown in the drawings depending upon the size of the roof and the size of the panels.

Flange 6 of panel 2*a* sits on the frame member 20 as previously described with the upper edge 36 of the panel trapped in the corner cap 5. It will be appreciated that flange 6 of panel 2*a* is supported on top of a frame member 20 such that the frame member that supports panel 2*a* is not visible in FIG. 8.

After panel 2*a* is properly located on the frame, panel 2*b* is slid into position. Specifically, flange 10 of panel 2*b* rests on and slides over flange 6 of panel 2*a*. Flange 6 of panel 2*b* rests on and slides over frame member 20. Panel 2*b* is slid towards the top of the structure in the direction of arrow A until the top edge 43 of panel 2*b* fits into ridge cap 3 and the edge 41 fits into corner cap 5.

Figure 6:
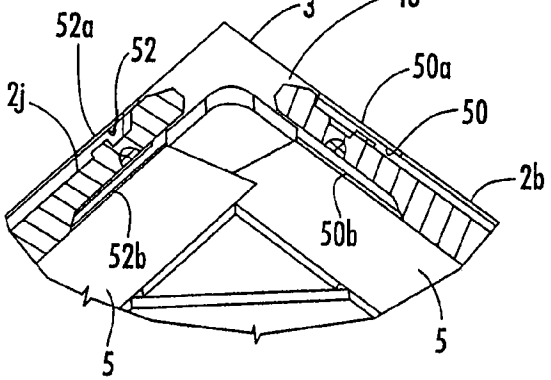
FIG. 6 shows a cross-section of a roof panel engaged with a ridge cap.

A more detailed view of the ridge cap 3 is shown in FIG. 6 where the upper edge 43 of panel 2*b* is inserted into a cavity 50 formed by ridge cap 3. The opposite side of ridge cap 3 defines a second cavity 52 that retains panels 2*i* and 2*j*. In the illustrated embodiment ridge cap 3 extends along the roof ridge line and between the corner caps 5 although the specific arrangement of the ridge cap and corner caps may vary depending on the type of structure and roof. First cavity 50 is formed along one longitudinal edge of ridge cap 3 and second cavity 52 is formed along the opposite longitudinal edge of ridge cap 3. In the illustrated embodiment the cavities 50 and 52 extend for substantially the entire length of the ridge cap 3. Cavity 50 is formed by opposed flanges 50*a* and 50*b* and cavity 52 is formed by opposed flanges 52*a* and 52*b*. The upper edge 43 of panel 2*b* that faces and abuts ridge cap 3 is inserted into a cavity 50. Likewise the upper edge of panel 2*c* is also inserted into cavity 50. The opposite cavity 52 of ridge cap 3 the upper edges of panels 2*i* and 2*j*. The ridge cap 3 may retain a greater or fewer number of panels than shown in the drawings depending upon the size of the roof and the size of the panels.

Because the panels span the entire distance between the lower edge of the roof and either the ridge cap 3 and/or corner cap 5, the panels can be pushed into place by a person from the outside of the building. Most people will be able to push the panels in place while standing on the ground or on a low ladder or step stool such that it is not required for a person to be on top of the roof to install the panels.

The panels are secured together using the pin and mounting structure as previously described with respect to FIG. 5. Like placement of the panels, the engagement of the pin and mounting structures can be accomplished from below the panel and inside of the structure. The process is repeated for each panel 2*c* through 2*n*. Note that because the flange 10 of one panel rests on the flange 6 of the adjacent panel, the panel in the underneath position should be installed first. In the illustrated embodiment, the panels are configured such that installation takes place from right to left on each roof section. If the flanges on the panels were reversed, the assembly would take place from left to right.

While the illustrated embodiment shows a particular size roof, it will be understood that the structure could be made larger or smaller by adding roof sections. The illustrated roof shows features such as a dormer 42 and skylight 44. These features are built into the panel before the roof is assembled such that the features can be added without changing the assembly steps of the roof. In the illustrated embodiment the features are mounted to a single roof panel.

While embodiments of the invention are disclosed herein, various changes and modifications can be made without departing from the spirit and scope of the invention. One of ordinary skill in the art will recognize that the invention has other applications in other environments. Many embodiments are possible. The following claims are in no way intended to limit the scope of the invention to the specific embodiments described above.

The invention claimed is:

1. A roof assembly comprising:

a first frame member and a second frame member each having a first end extending from a top of the roof and a second end defining an edge of the roof; said first frame member supporting a first panel and a second panel and said second frame member supporting said second panel and a third panel such that a first seam between the first panel and the second panel is located over said first frame member and a second seam between the second panel and the third panel is located over said second frame member, said first panel including a first mounting structure located on a bottom of the first panel and positioned such that the first mounting structure is located under the first panel and to a first side of the first frame member when the first panel is supported on the first frame member; said second panel including a second mounting structure and a third mounting structure located on a bottom of the second panel and positioned such that the second mounting structure and the third mounting structure are located under the second panel with the second mounting structure on a second side of the first frame member and the third mounting structure on a first side of the second frame member when the second panel is supported on the first frame member and the second frame member; said third panel including a fourth mounting structure located on a bottom of the third panel and positioned such that the third mounting structure is located under the third panel and at a second side of the second frame member when the third panel is supported on the second frame member;

and a first connecting member engaging at least one of the first mounting structure and the second mounting structure and said first frame member for connecting said at least one of the first and second panels to the first frame member, and a second connecting member engaging at least one of the third mounting structure and the fourth mounting structure and said second frame member for connecting said at least one of the second and third panels to the second frame member, said first connecting member and said second connecting member being located below the first, second and third panels such that said first and second connecting members engage said first, second, third panels from below the first, second and third panels.

2. The roof assembly of claim 1 wherein the first connecting member connects the first panel to the second panel and the second connecting member connects the second panel to the third panel.

3. The roof assembly of claim 1 wherein the first panel joins the second panel in a first lap joint and the second panel joins the third panel in a second lap joint.

4. The roof assembly of claim 3 wherein the first lap joint includes a channel formed on the first panel.

5. The roof assembly of claim 4 wherein the first lap joint includes a second channel formed on the second panel.

6. The roof assembly of claim 3 wherein the second panel includes a third channel and the third panel includes a fourth channel where the third channel and fourth channel engage one another to create the second lap joint.

7. The roof assembly of claim 3 wherein the first lap joint and the second lap joint extend for substantially the entire length of the first, second and third panels.

8. The roof assembly of claim 1 wherein the first panel is supported directly on said first frame member and said second panel is supported on the first panel.

9. The roof assembly of claim 1 wherein the first connecting member extends between the first and second panels.

10. The roof assembly of claim 9 wherein the first connecting member engages the first panel, the second panel and the first frame member.

11. The roof assembly of claim 9 wherein the first connecting member engages holes formed in the first panel, the second panel and the first frame member.

12. A method of a assembling a roof having a roof edge on a structure comprising:

providing a roof frame having a plurality of frame members each having a first end extending from a ridge cap and a second end defining an edge of the roof;

providing a first panel with a first mounting structure located on a bottom of the first panel and a second panel with a second mounting structure located on a bottom of the second panel;

sliding said first panel onto a first frame member of said plurality of frame members and a second frame member of said plurality of frame members such that the first panel extends from the ridge cap to the roof edge and said first mounting structure is on a first side of said second frame member;

sliding said a second panel onto said first panel and a third frame member of said plurality of frame members such that the second panel extends from the ridge cap to the roof edge and said second mounting structure is on a second side of said second frame member; connecting said first panel and said second panel to said second frame member with a connecting member from a location completely under the first and second panels.

13. The method of claim 12 wherein the first panel is slid onto said frame from below said panel.

14. A roof assembly comprising:

a plurality of frame members each having a first end extending from a ridge cap and a second end defining an edge of the roof; each of said plurality of frame members supporting a first panel and a second panel such that a seam between the first panel and second panel is located over said plurality of frame members, said first panel including a first mounting structure located on a bottom of the first panel and said second panel including a second mounting structure located on a bottom of the second panel, said roof panels extending between the ridge cap and the second end of the plurality of frame members; and a connecting member engaging the first panel on one side of one of the plurality of frame members, the second panel on an opposite side of the one of the plurality of frame members and the one of the plurality of frame members for connecting the first panel and the second panel to the one of the plurality of frame members, said connecting member being located under the first panel and the second panel such that said connecting member engages the first panel and the second panel from below the first panel and the second panel.

15. The roof assembly of claim 14 wherein the first panel joins the second panel in a lap joint.

16. The roof assembly of claim 15 wherein the lap joint includes a second channel formed on the second panel.

17. The roof assembly of claim 15 wherein the lap joint includes a channel formed on the first panel.

18. The roof assembly of claim 14 wherein the first panel includes a first channel and the second panel includes a second channel where the first channel and the second channel engage one another to create a lap joint.

19. The roof assembly of claim 18 wherein the lap joint extends for substantially the entire length of the panels.

20. The roof assembly of claim 14 wherein the first panel is supported directly on said one of the plurality of frame members and said second panel is supported on the first panel.

21. The roof assembly of claim 14 wherein an edge of the first panel is engaged in a corner cap.

22. The roof assembly of claim 14 wherein the corner cap includes a first cavity for receiving the first panel.

23. The roof assembly of claim 22 wherein the corner cap includes a second cavity for receiving another panel.

24. The roof assembly of claim 14 wherein the ridge cap includes a first cavity for receiving the second panel.

25. The roof assembly of claim 24 wherein the ridge cap includes a second cavity for receiving another panel.

26. The roof assembly of claim 14 wherein the connecting member engages holes formed in the first panel, the second panel and the one of the plurality of frame members.

* * * * *